United States Patent [19]

Patenaude et al.

[11] 4,294,158

[45] Oct. 13, 1981

[54] GUN BOLT CONTROL MECHANISM

[75] Inventors: Raymond A. Patenaude, Burlington; Thomas W. Cozzy, South Burlington; Stephen J. Bullis, Colchester, all of Vt.

[73] Assignee: General Electric Company, Burlington, Vt.

[21] Appl. No.: 2,037

[22] Filed: Jan. 8, 1979

[51] Int. Cl.[3] ..... F41D 7/04

[52] U.S. Cl. ..... 89/12

[58] Field of Search ..... 89/9, 11, 12, 160

[56] References Cited

U.S. PATENT DOCUMENTS

| | | | |
|---|---|---|---|
| 698,472 | 4/1902 | Driggs | 89/12 |
| 1,242,068 | 10/1917 | Stoddard | 89/12 |
| 1,801,179 | 4/1931 | Stange | 89/12 |
| 2,849,921 | 9/1958 | Otto | 89/12 |
| 2,965,003 | 12/1960 | McThomas | 89/126 |
| 2,971,440 | 2/1961 | O'Brien | 89/126 |
| 2,998,758 | 9/1961 | Ovellette | 89/155 |
| 3,071,043 | 1/1963 | McThomas | 89/12 |
| 3,198,074 | 8/1965 | Perkins | 89/12 |
| 3,263,565 | 8/1966 | Dragonetti et al. | 89/1.804 |
| 3,380,342 | 4/1968 | Chiabrandy | 89/12 |
| 3,834,272 | 9/1974 | Patenaude et al. | 89/12 |
| 4,114,511 | 9/1978 | Patenaude | 89/33 CA |

*Primary Examiner*—Stephen C. Bentley

*Attorney, Agent, or Firm*—Bailin L. Kuch

[57] ABSTRACT

This invention has the provision in an automatic gun having a relatively small diameter barrel cluster, which rotates at a first velocity, of a relatively small diameter stationary cam track which controls and drives the gun bolts through their respective fore and aft dwells and adjacent accelerations and decelerations, and an additional relatively small diameter cam track which rotates in the opposite direction at a multiple of said first velocity to control and drive the gun bolts through the crossovers of the stationary cam track.

5 Claims, 12 Drawing Figures

FORWARD CAM

FIG. 9 AFT CAM

GUN BOLT CONTROL MECHANISM

BACKGROUND OF THE INVENTION

1. Field of the Invention

This invention relates to mechanisms for controlling the gun bolts in automatic guns, such as Gatling type guns, having a relatively small diameter rotating barrel cluster.

2. Prior Art

Automatic guns having relatively small diameter rotating barrel clusters are shown on U.S. Pat. No. 3,834,272 issued to R. A. Patenaude et al on Sept. 10, 1974, and in U.S. Pat. No. 4,114,511 issued to R. A. Patenaude on Sept. 19, 1978. In such guns the gun barrels are very close to each other about the longitudinal axis of the gun and conventional systems for controlling and driving the gun bolts are not appropriate unless the diameter of the gun is increased significantly. In a more conventional gun, such as is shown in U.S. Pat. No. 3,380,342 issued to R. E. Chiabrandy on Apr. 30, 1968 a single, substantially helical cam track is provided to control and drive the gun bolts. However, if the diameter of the helix of such a cam track were to be significantly reduced, the drive angle of the track would be significantly increased and the cam would block the bolt. Similar systems are shown for example in U.S. Pat. No. 698,472 issued to L. L. Driggs on Apr. 29, 1902, U.S. Pat. No. 1,242,068 issued to V. Stoddard on Oct. 2, 1917, U.S. Pat. No. 1,801,179 issued to L. Stange on Apr. 14, 1931, U.S. Pat. No. 2,849,921 issued to H. McC. Otto on Sept. 2, 1958, U.S. Pat. No. 2,965,003 issued to W. D. McThomas on Dec. 20, 1960, U.S. Pat. No. 2,971,440 issued to J. F. O'Brien on Feb. 14, 1961, U.S. Pat. No. 2,998,758 issued to H. J. Ouellette on Sept. 5, 1961, U.S. Pat. No. 3,071,043 issued to W. D. McThomas on Jan. 1, 1963, U.S. Pat. No. 3,198,074 issued to W. E. Perkins on Aug. 3, 1965, and U.S. Pat. No. 3,263,565 issued to A. J. Dragonetti et al on Aug. 2, 1966.

An object of this invention is to provide a mechanism for controlling and driving the gun bolts in an automatic gun having a relatively small diameter rotating barrel cluster.

A feature of this invention is the provision in an automatic gun having a relatively small diameter barrel cluster which rotates at a first velocity, of a relatively small diameter stationary cam track which controls and drives the gun bolts through their respective fore and aft dwells and adjacent accelerations and decelerations, and an additional relatively small diameter cam track which rotates in the opposite direction at a multiple of said first velocity to control and drive the gun bolts through the cross-overs of the stationary cam track.

BRIEF DESCRIPTION OF THE DRAWING

These and other objects, advantages and features of the invention will be apparent from the following specification thereof taken in conjunction with the accompanying drawing in which.

DESCRIPTION OF THE INVENTION

Figure 1A:
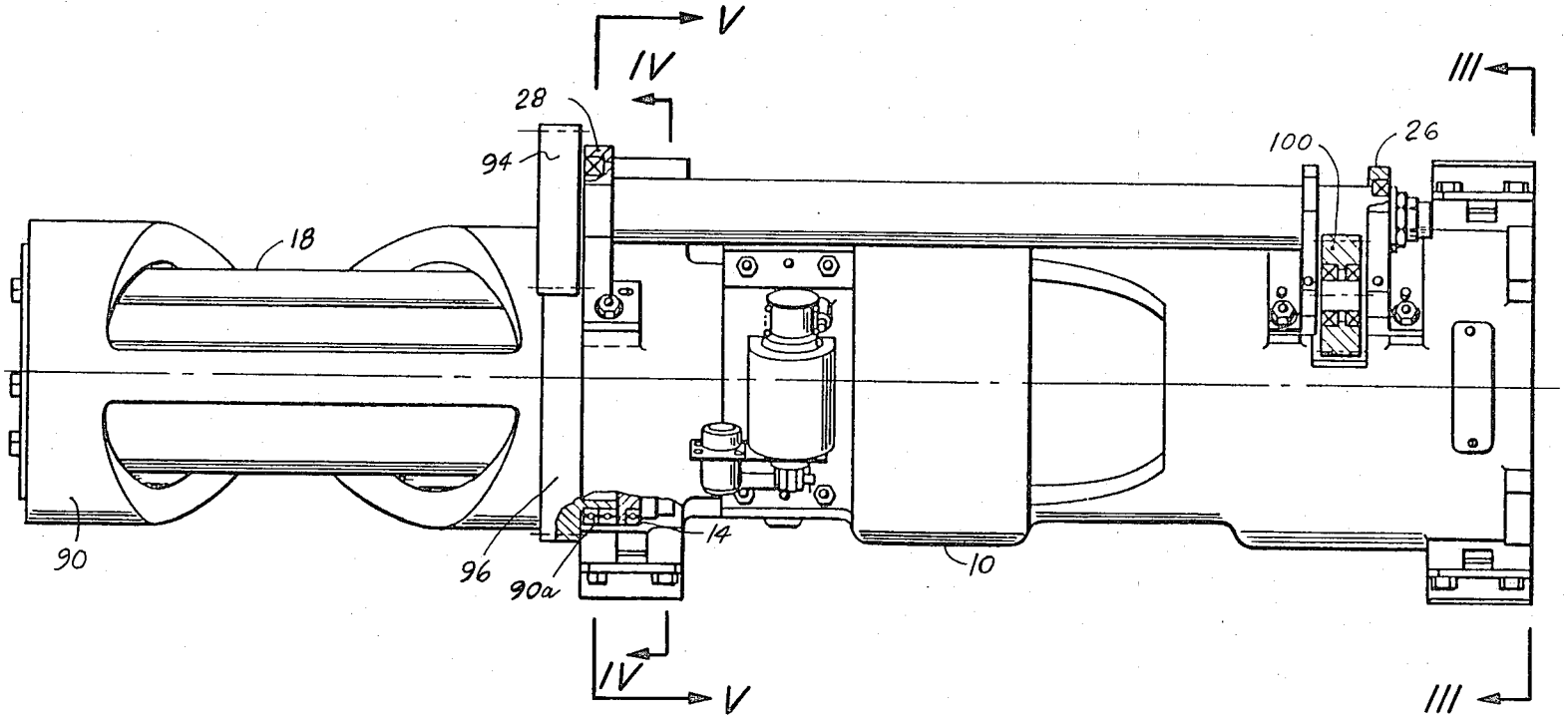
FIGS. 1A and 1B taken together form FIG. 1 which is a top view of a gun incorporating an embodiment of this invention.
Figure 1B:
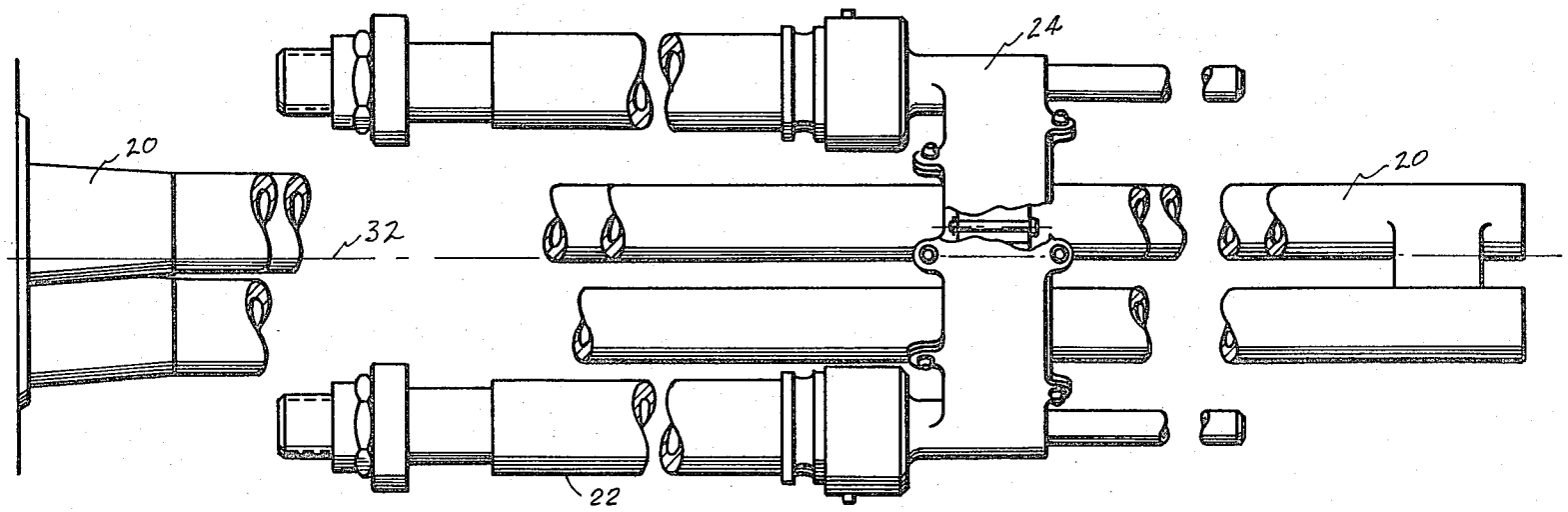
Figure 2A:
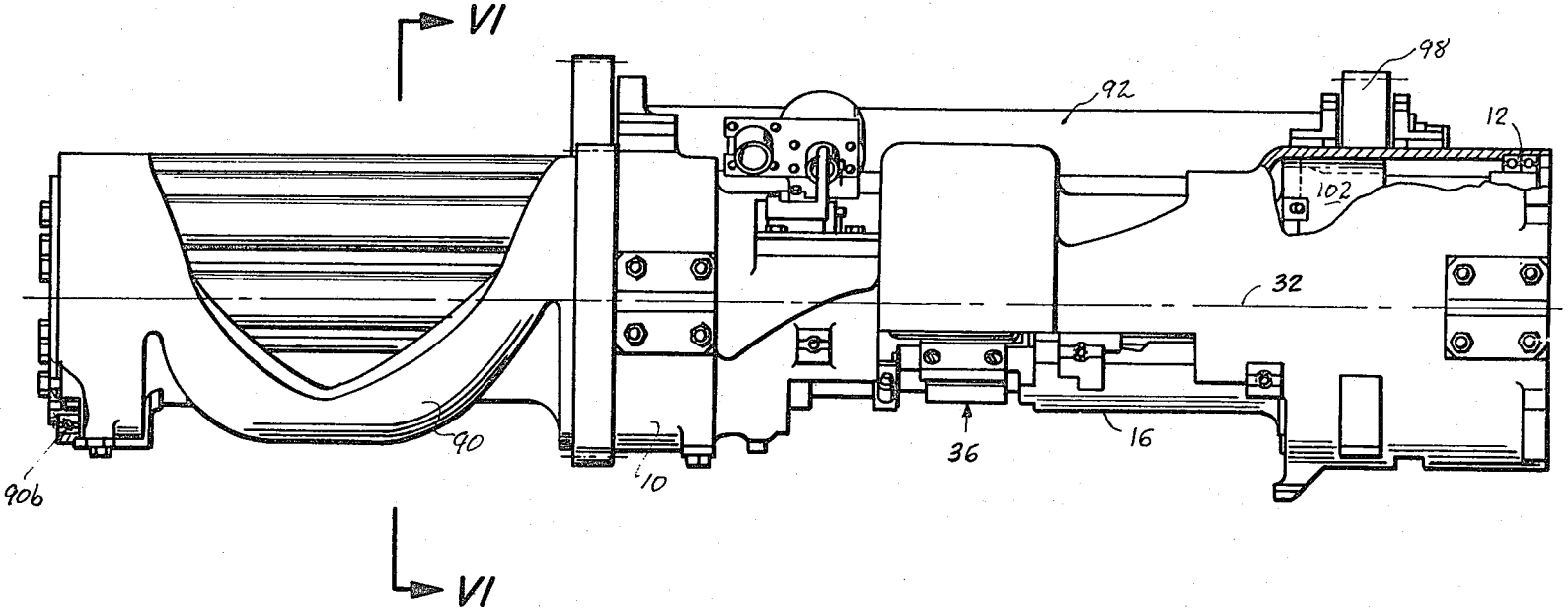
FIGS. 2A and 2B taken together form FIG. 2 which is a side view of the gun of FIG. 1.
Figure 2B:
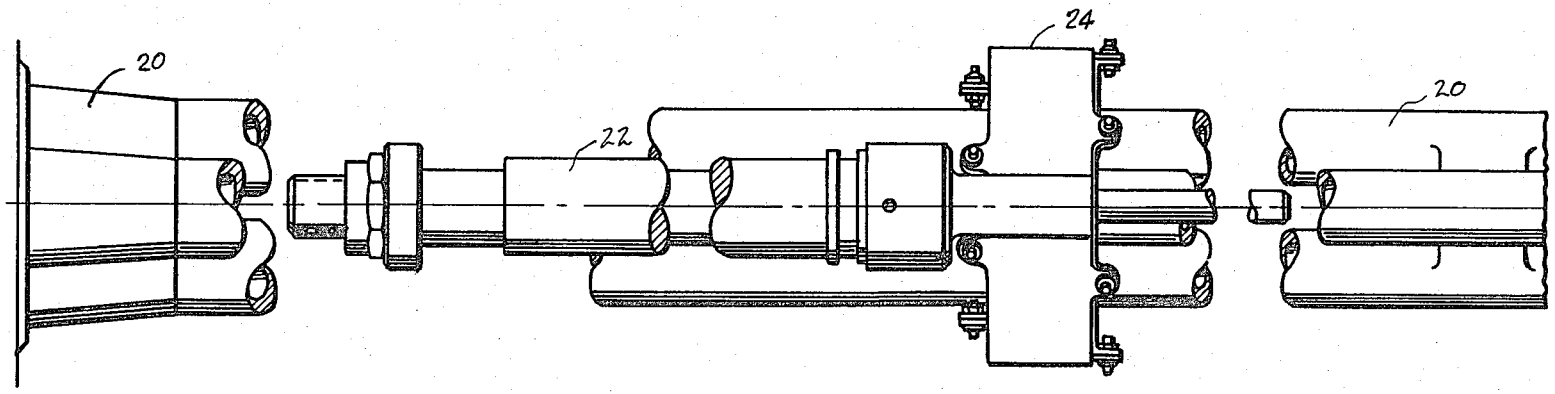
Figure 5:
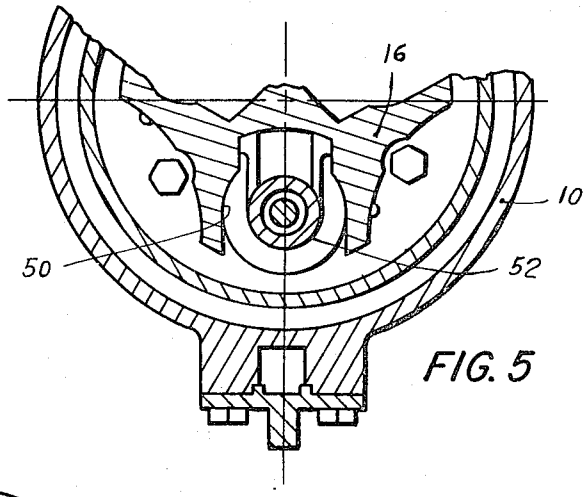
FIG. 5 is a view in cross-section taken long plane V—V of FIG. 1.
Figure 6:
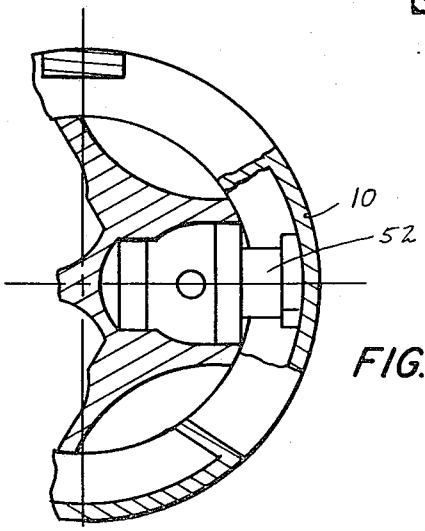
FIG. 6 is a view in cross-section taken along plane VI—VI of FIG. 2A.
Figure 3:
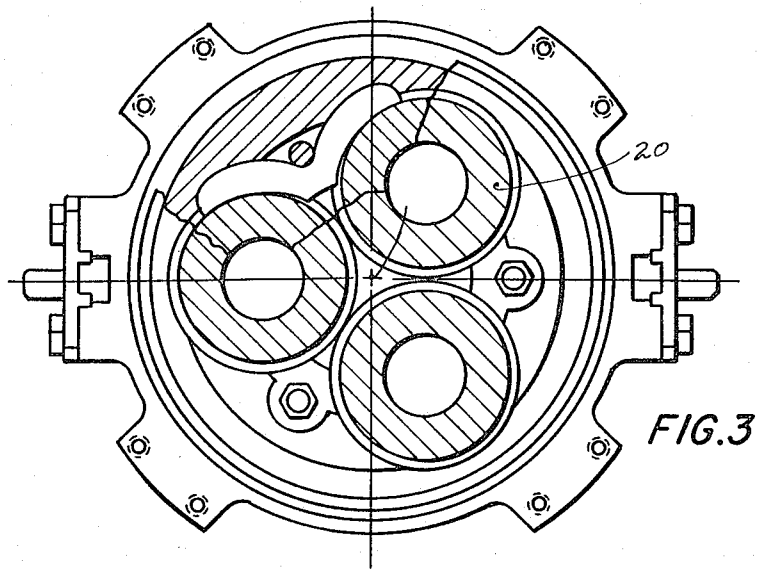
FIG. 3 is a view in cross-section taken along plane III—III of FIG. 1.
Figure 4:
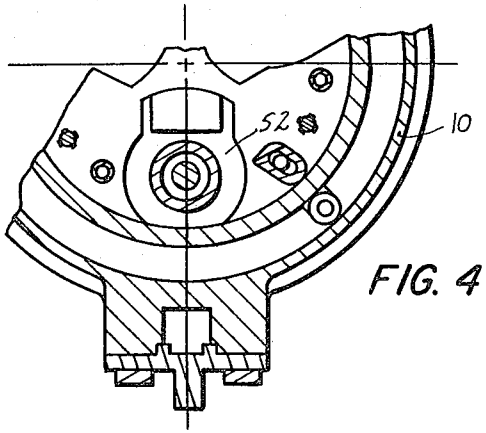
FIG. 4 is a view in cross-section taken along plane IV—IV of FIG. 1.
Figure 7:
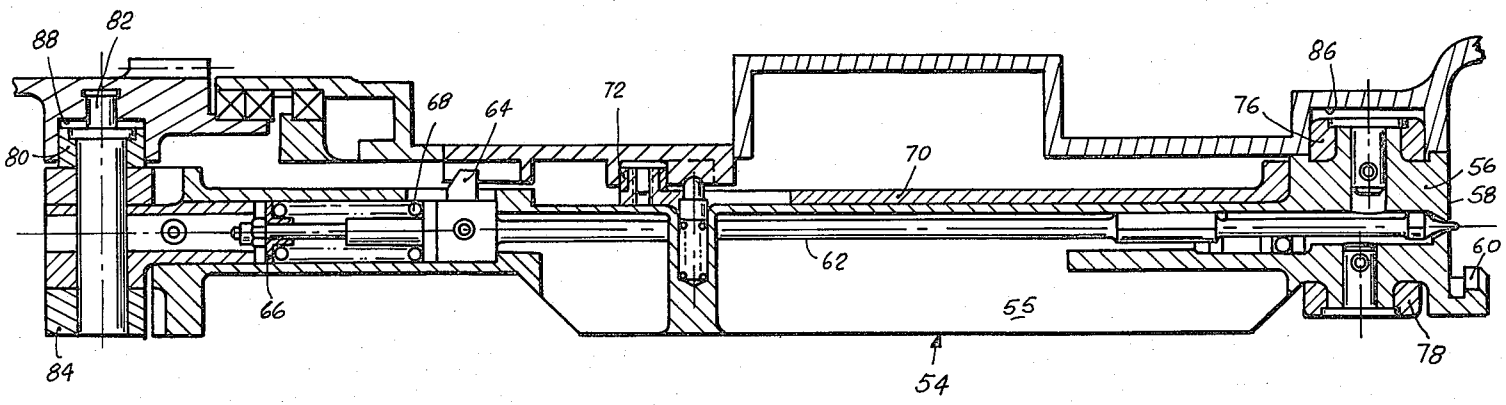
FIG. 7 is a detail in longitudinal cross-section of the gun of FIG. 1 showing the gun bolt controlled by both a forward stationary cam tracking in the housing and an aft cam track in a rotating drum cam.
Figure 8:
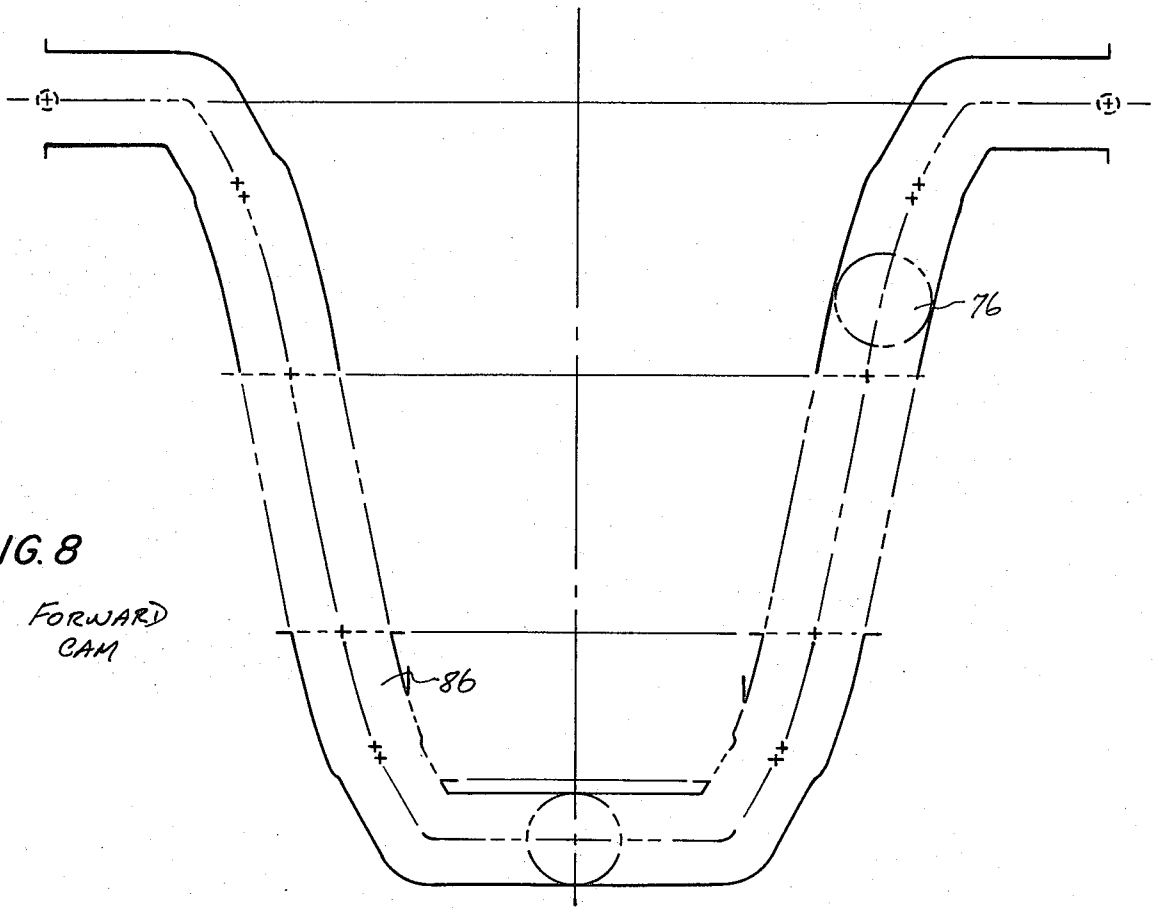
FIG. 8 is a flat development of the forward stationary cam.
Figure 9:
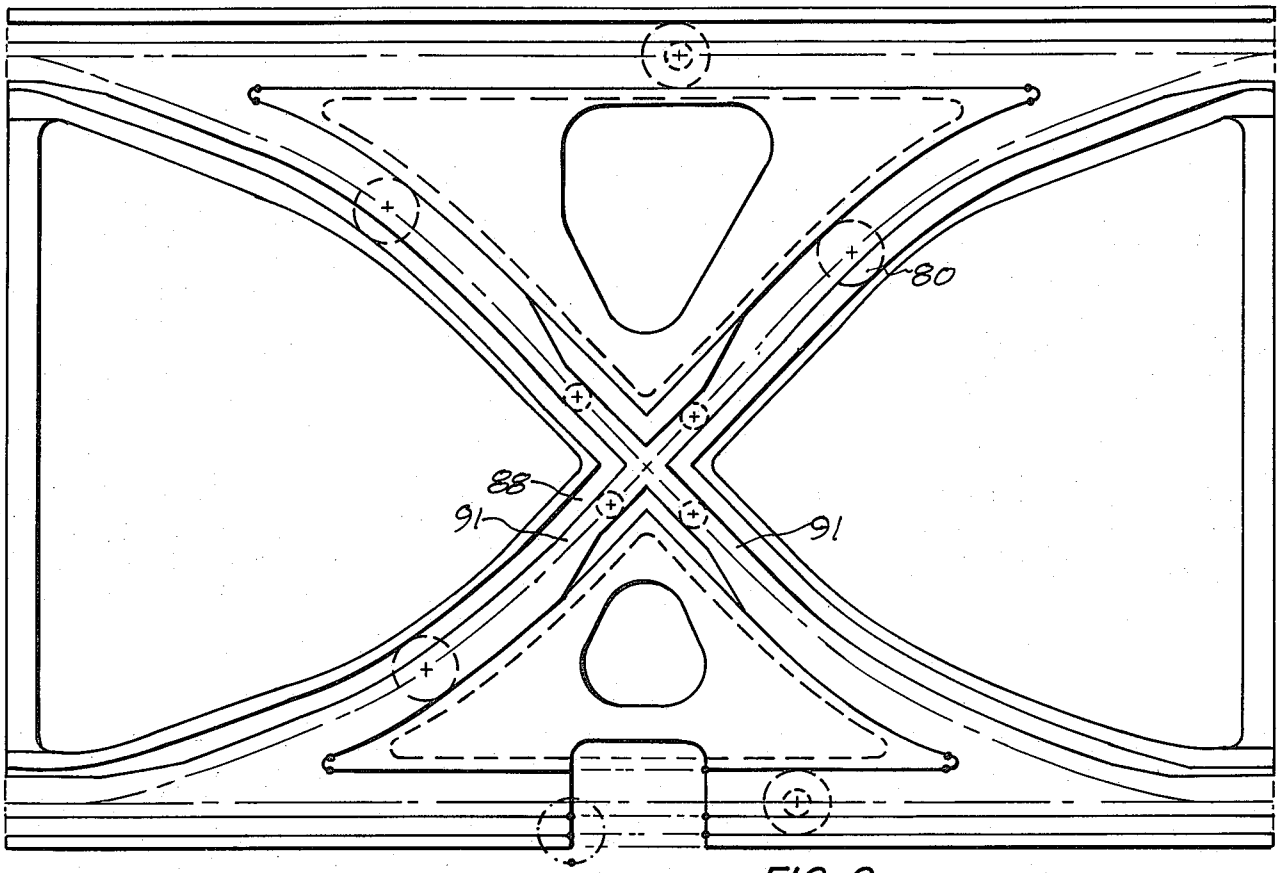
FIG. 9 is a flat development of the aft rotating cam.
Figure 10:
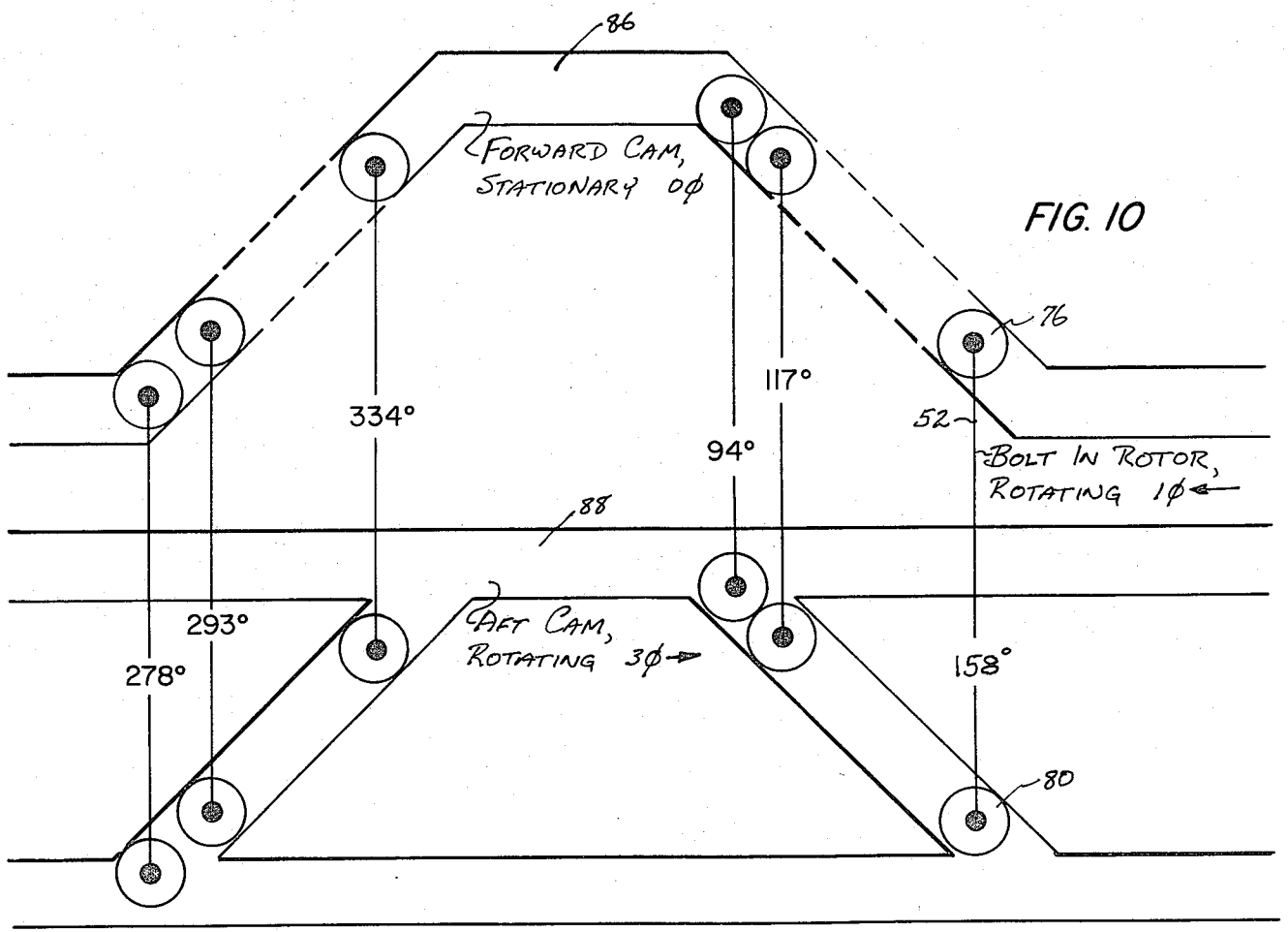
FIG. 10 is a diagram of the cams showing the gun bolts at different positions in the gun cycle.

The invention is incorporated in a gun of the small diameter rotor type such as is shown in U.S. Pat. Nos. 3,834,272 and 4,114,511 and is shown in FIGS. 1 and 2. The gun includes a stationary housing 10, in which journaled by fore and aft bearings 12 and 14 is a rotor 16, to which rotor are fixed a rotor extension 18 and three gun barrels 20. The barrels are in a tight annular row with the outside walls of the barrels touching adjacent their respective chamber areas. The gun is supported by a pair of recoil adapters 22 which are fixed between a support, not shown, and a clamp assembly 24. The clamp assembly has an outer part fixed to the recoil adapters and an inner part clamping a medial part of each of said barrels respectively, and journaled for rotation within said outer part. The gun is also supported at a forward drive support 26 and an aft drive support 28.

The rotor 16 revolves about the longitudinal axis 32 of the gun within the housing 10. The rotor has three slots 50, each receiving a respective gun bolt assembly 52.

Each gun bolt assembly 52 includes a bolt body 54, having a lower rib 55, a bolt head 56 with a bolt face 58 and an extractor hook 60, a firing pin 62 with a cocking lever 64, a fixed spring retainer 66 and a helical compression spring 68. The assembly also includes a slider 70 having a roller 72 for operating the bolt locking blocks, not shown. The bolt head carries an upper roller 76 and a lower roller 78. The aft end of the body carries an upper roller 80, an uppermost, track following, pilot shoe 82, and a lower roller 84. The rib 55, and the lower rollers 78 and 84, ride in the longitudinally extending slot 50 in the rotor 16. The forward upper roller 76 rides in a substantially helical cam track 86 provided in the inner wall of the housing 10. The helical cam track is stationary and the rotor rotates counterclockwise about the gun longitudinal axis at a first rotational velocity of $\phi$. The aft upper roller 80, with its pilot shoe 82, rides in a control cam track 88, formed in the inner wall of a drive cam 90 which is journaled in fore and aft bearings **90*a* and 90*b* for rotation with respect to both the housing and the rotor. The pilot shoe 82 rides in a pilot track 91 recessed in the cam track 88. A shaft 92 which is driven by an external source of power, not shown, has an aft gear 94 which is meshed with a ring gear 96 in the driven cam 90, and has a forward gear 98, which is meshed with an idler gear 100 which in turn is meshed with a ring gear 102 on the rotor. The shaft drives the rotor, as previously mentioned, counterclockwise at a velocity $\phi$, and drives the driven cam 90** clockwise about the gun longitudinal axis at a second velocity of $3\phi$. Thus if the rotor were to be considered the datum, e.g., stationary, the forward cam would be rotating at $+\phi$ with respect to the rotor, and the aft cam would be rotating at $+4\phi$. The forward cam controls and drives the bolt through its fore and aft dwells and adjacent accelerations and decelerations. However, the maximum slope of the cross-overs on this cam is too steep to drive the gun bolt, and is, in fact, omitted. The aft cam controls and drives the bolt through the crossovers, the aft bolt roller being guided through the switches in the aft cam track by its pilot shoe in the pilot track. The $1\phi$ to $4\phi$ velocity relationship of the forward cam to the aft cam is determined by the necessity to synchronize the two cams, e.g. each cam must be in aft (or forward) dwell at the same time for each gun bolt. The general relationship follows:

Where

X=number of gun bolts, $\phi_F$=rotational velocity of the forward cam relative to the rotor, $\phi_A$=rotational velocity of the aft cam relative to the rotor, then, relative to the rotor, i.e., taking the rotor as stationary, $$\phi_A=\phi_F+X\phi_F=(X+1)\phi_F;$$

or, taking the forward cam as stationary, and the rotational velocity of the rotor as $-\phi_F$, then $$\phi_A=-X\phi_F.$$

We claim:

1. An automatic gun including:

a housing;

a rotor journaled for rotation on a longitudinal axis relative to said housing;

a plurality of gun bolts carried by and journaled for reciprocation in said rotor, each gun bolt having a respective cycle of operation;

a first cam means coupled to and driving in reciprocation each of said gun bolts during a first portion of the respective cycle of operation of each of said gun bolts; and a second cam means coupled to and driving in reciprocation each of said gun bolts during a second portion of said respective cycle of operation of each of said gun bolts.

2. An automatic gun including:

a housing;

a rotor journaled for rotation on a longitudinal axis relative to said housing;

a plurality of gun bolts carried by and journaled for reciprocation in said rotor, each gun bolt having a respective cycle of operation, a first cam means coupled to and driving each of said gun bolts during a first portion of the respective cycle of operation of each of said gun bolts; and a second cam means coupled to and driving each of said gun bolts during a second portion of said respective cycle of operation of each of said gun bolts;

each of said gun bolts having a respective first cam follower and a respective second cam follower;

said first cam means including a first cam track receiving and guiding each of said first cam followers;

said second cam means including a second cam track receiving and guiding each of said second cam followers;

said first cam track having a first rotational velocity with respect to said rotor; and said second cam track having a second rotational velocity, different from said first rotational velocity, with respect to said rotor.

3. A gun according to claim 2 wherein: p1 said first cam track controls each of said bolts during its respective fore and aft dwells and adjacent accelerations and decelerations during its respective cycle of operation; and said second cam track controls each of said bolts during the remainder of its respective cycle of operation.

4. A gun according to claim 2 wherein:

said plurality of gun bolts is equal to X in number;

said first rotational velocity of said first cam track relative to said rotor is $\phi_F$;

said second rotational velocity of said second cam track relative to said rotor is $(X+1)\ \phi_F$.

5. A gun according to claim 4 wherein:

X is 3;

said first rotational velocity is $\phi_F$; and said second rotational velocity is $4\phi_F$.

* * * * *

UNITED STATES PATENT AND TRADEMARK OFFICE

CERTIFICATE OF CORRECTION

ATENT NO. : 4,294,158

)ATED : October 13, 1981

NVENTOR(S) : Raymond A. Patenaude, Thomas W. Cozzy, Stephen J. Bullis

It is certified that error appears in the above-identified patent and that said Letters Patent are hereby corrected as shown below:

Column 2, line 3, change "long" to --along--.

Column 4, line 30, delete "pl".

Signed and Sealed this

*Sixth* Day of *April 1982*

|SEAL|

*Attest:*

GERALD J. MOSSINGHOFF

*Attesting Officer*

*Commissioner of Patents and Trademarks*